US007037070B2

(12) United States Patent
Raine et al.

(10) Patent No.: US 7,037,070 B2
(45) Date of Patent: May 2, 2006

(54) VARIABLE PITCH DEVICE FOR TWO BLADE STAGES FIXED ONTO A TURBOJET

(75) Inventors: Florent Raine, Montgeron (FR); Dominique Raulin, Avon (FR); Alain Chatel, Vaux le Penil (FR)

(73) Assignee: Snecma Moteurs, Paris (FR)

( * ) Notice: Subject to any disclaimer, the term of this patent is extended or adjusted under 35 U.S.C. 154(b) by 120 days.

(21) Appl. No.: 10/870,050

(22) Filed: Jun. 18, 2004

(65) Prior Publication Data

US 2005/0129510 A1 Jun. 16, 2005

(30) Foreign Application Priority Data

Jun. 20, 2003 (FR) ..... 03 50237

(51) Int. Cl.
*F01D 17/16* (2006.01)

(52) U.S. Cl. ..... 415/162; 415/149.4

(58) Field of Classification Search ..... 415/149.2, 415/149.4, 150, 159, 160, 161, 162
See application file for complete search history.

(56) References Cited

U.S. PATENT DOCUMENTS 2,924,375 A * 2/1960 McKissock ..... 415/149.4
3,066,488 A * 12/1962 Mock ..... 415/161
3,083,892 A * 4/1963 Carey et al. ..... 415/17
3,873,230 A * 3/1975 Norris et al. ..... 415/162
4,403,912 A * 9/1983 Pekari et al. ..... 415/150
5,044,879 A * 9/1991 Farrar ..... 415/150
5,190,439 A * 3/1993 Das ..... 415/149.4
5,692,879 A * 12/1997 Charbonnel ..... 415/159
6,092,984 A * 7/2000 Bouyer ..... 415/162

* cited by examiner

*Primary Examiner*—Christopher Verdier
(74) *Attorney, Agent, or Firm*—Oblon, Spivak, McClelland, Maier & Neustadt, P.C.

(57) ABSTRACT

The pitch control mechanism (controlling the angular position) for stator blades in a turbojet may be adjusted separately for two adjacent stages of blades controlled by a common actuator 10. To achieve this, the synchronization bar 9 located between the mechanisms leading to the two stages is inclined, this inclination being determined by a pin 22 and groove 23 connection with the casing, while another pin 26 and groove 27 connection is arranged between the synchronization bar 9 and one of the mechanisms. Strongly non-linear displacement laws between the two mechanisms may thus be controlled depending on the shapes and directions of the grooves.

1 Claim, 3 Drawing Sheets

VARIABLE PITCH DEVICE FOR TWO BLADE STAGES FIXED ONTO A TURBOJET

This invention relates to a variable pitch device for two stator stages on a turbojet.

The circular blade stages mounted on the stator of turbojets are often variable pitch, in other words the blades are capable of pivoting around their axis to vary the flow straightening characteristics that they impose on gases. The adjustment device is mounted outside the casing and includes an actuator mechanism and a transmission mechanism to the blade pivots. There are many variants, but they usually include a control lever for each blade, a synchronization ring placed around the casing to which all levers associated with blades in the same stage are connected, and an actuator means usually consisting of a jack with a rod that may be extended or retracted. The actuator means is connected to the ring by a transmission device that may include a synchronization bar starting from the jack rod, a connecting rod articulated to the ring and a bellcrank joining the synchronization bar to the ring control connecting rod and articulated to them. The bellcranks are parts that pivot about a central axis and are provided with two branches forming an angle, one of which is connected to the synchronization bar and the other connected to the control connecting rod. Movement of the jack displaces the synchronization bar, and this movement turns the bellcrank. The movement is communicated to the connecting rod that pulls or pushes on the synchronization ring and makes it turn around the casing, finally tilting the blade pivot control levers.

When there are several variable pitch blade stages, it frequently happens that they are all controlled by a single actuator. The remainder of the device is multiplied by the number of stages, either all the synchronization bars end at the actuator, or they form a chain passing through the bellcranks. This type of device only enables simple controls of blade stages, in which rotation of the blades is more or less a linear function of the relative displacement of the jack. This is not always desirable, particularly when several blade stages are controlled by the same actuator means, it may be desirable to control them in sequence, or by completely different control laws in order to obtain the best adjustment of the turbojet for the different speeds considered.

Document U.S. Pat. No. 3,083,892 A describes a device in which the jack rod is connected to a cam that it turns. The cam is fitted with a groove in which a pin of a rod is engaged and the rod is used to control the synchronization ring. It is thus possible to impose non-linear control laws, for example sinusoidal control laws, between the jack rod and the synchronization ring. A single blade stage is controlled by the above mentioned rotating cam means and by several others that are unrelated to the invention.

The rotating cam is added only to obtain the non-linear control law. It should probably have a large area so that a groove can be formed in it enabling irregular or large amplitude control laws. This patent does not solve the different control of two blade stages by a single actuator means. The rotating cam is similar in shape to a bellcrank, and the adaptation of a groove and a pin sliding in the groove in an existing bellcrank would not be good for controlling several stages at the same time, because it is difficult to increase the surface area of bellcranks due to their proximity on the casing. Finally, large forces are developed in the bellcrank, so that it is not a good idea to weaken it with a long groove. The invention relates to a device that can be used for varying the pitch according to non-linear and different laws for several stages of blades at the same time, using a device completely different from the device used in above-mentioned prior art.

In its most general form, it relates to a variable pitch device for two stator blade stages arranged on a casing and provided with an actuator mechanism, and a bellcrank for each stage pivoting on an axis of the casing and a stage control connecting rod connected to a branch of the bellcrank, a synchronization bar being connected to another branch of at least one of the bellcranks to displace it, characterized in that one of the synchronization bars is connected to the casing through a groove connection and a pin sliding in the groove, and to the bellcrank that it displaces by a groove connection and a pin sliding in the groove.

The invention will now be described with reference to the following figures.

Figure 3A:
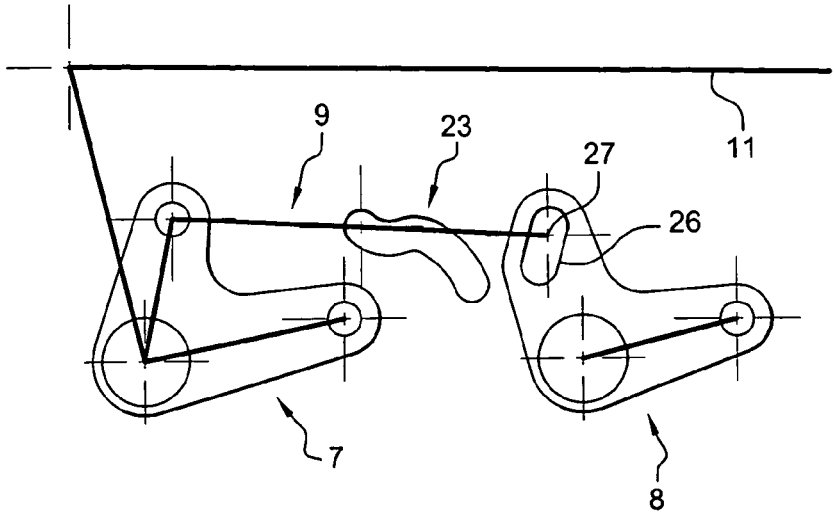
Figure 3B:
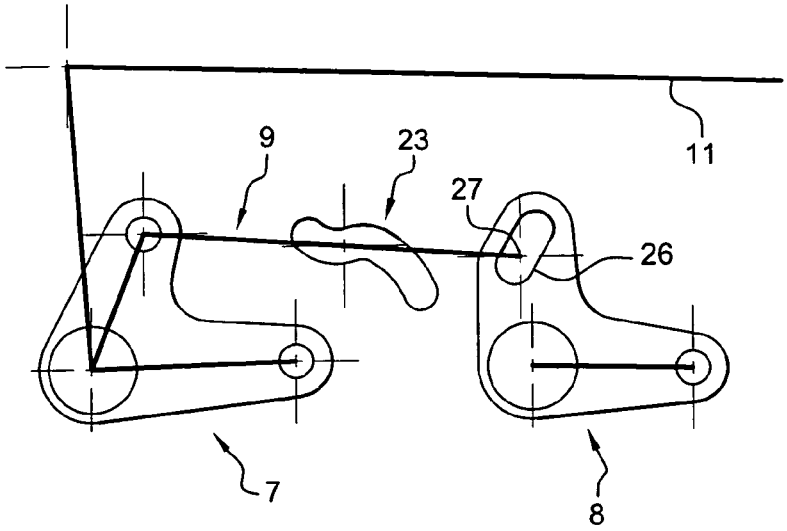
Figure 3C:
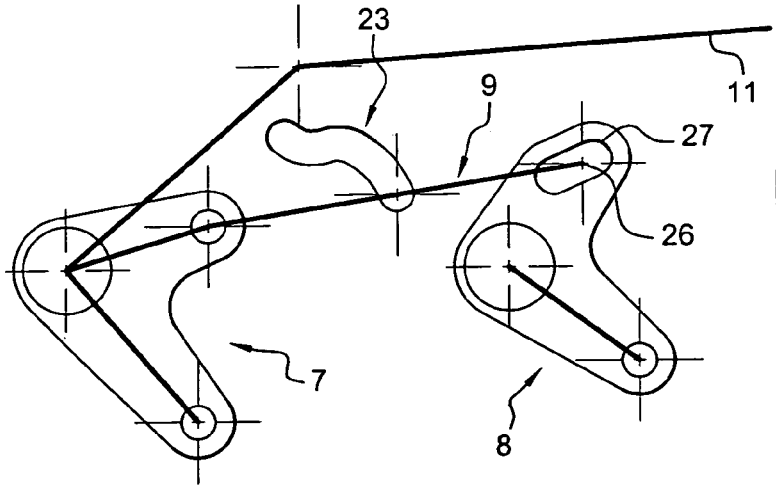

FIGS. 3*a*, 3*b* and 3*c* illustrate one possible control law.

Figure 1:
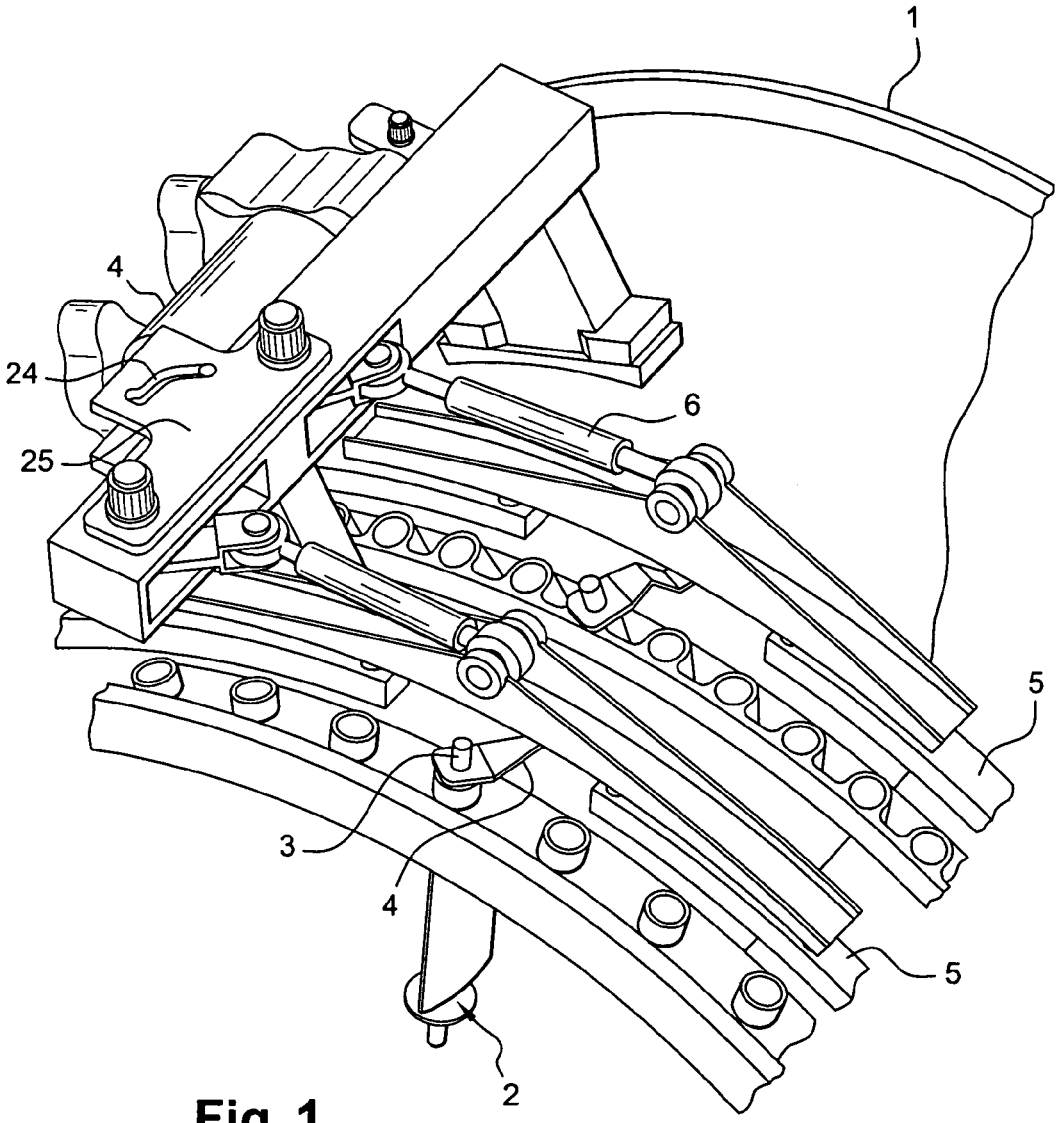
FIG. 1 illustrates the mechanism.
Figure 2:
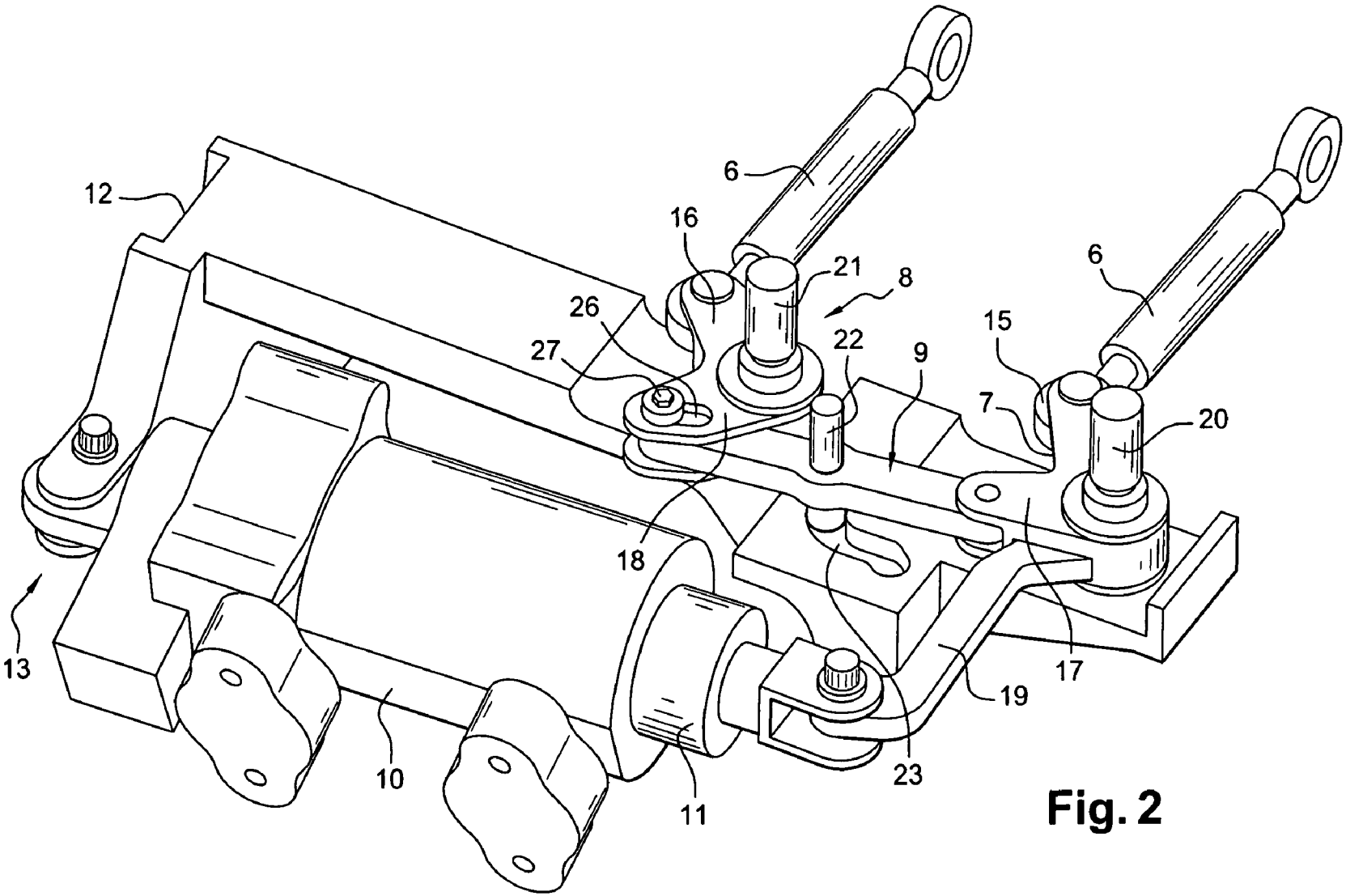
FIG. 2 shows a detail view.

The system considered as a whole is shown in FIG. 1. A turbojet casing is marked as reference 1; the blades (only one of which is shown) 2 are installed inside on external pivots 3 passing through the casing 1 and on internal pivots not shown and connected together by a connecting ring; each of the blades 2 is adjusted by the device that will now be described. It comprises levers 4 installed on external pivots 3, synchronization rings 5 each associated with one stage of blades 2, extending at the side of them and at the ends of which the levers 4 are mounted free to rotate, control connecting rods 6, that are tensioning screws and that extend tangentially to the rings 5, and as shown in FIG. 2, bellcranks 7 and 8 to which the ends of the connecting rods 6 opposite the synchronization rings 5 are installed free to rotate, a synchronization bar 9 and a jack 10 with a rod 11 actuating one of the bellcranks 7, the body of which is installed on a housing 12 of the casing 1 free to rotate about a trunnion 13. The synchronization bar 9 connects two branches 15 and 16 of the bellcranks 7 and 8 articulated to them, the said branches 15 and 16 being opposite the branches 17 and 18 to which the connecting rods 6 are articulated; the bellcrank 7 also comprises a branch 19 to which the rod 11 is articulated to control the movement of the entire mechanism. Finally, the bellcranks 7 and 8 are installed free to rotate on the housing 12, about axes 20 and 21 that are parallel to each other.

The movements of the rod 11 cause rotation of the bellcrank 7, and another rotation of the bellcrank 8 through the synchronization bar 9; the rotations of the bellcranks 7 and 8 in turn move the connecting rods 6, the rings 5, the levers 4 and the blades 2 making them turn through the required angle, the control law being particularly dependent on the lengths and angles of the branches 15, 16, 17 and 18.

According to the invention, the synchronization bar 9 is fitted with a pin 22 that penetrates into a groove 23 formed in the casing 12. Moreover, a second groove 26 is formed in the second bellcrank 8 in which a pin 27 is fitted at the end of the synchronization bar 9.

A tab 25 fixed to the housing 12, already used to support the pivots of the bellcranks 7 and 8 of the side opposite the housing 12 itself, also carries a replica 24 of the groove 23, in which another portion of the pin 22 penetrates in order to complete guidance of the synchronization bar 9.

The direction of the synchronization bar 9 is imposed at all deployment positions of the rod 11 of the jack 10 through the groove 23. The rotation angles of the bellcranks 7 and 8 vary by different values. The shape and direction of the groove 23 are determined to give the required control law for the blade stage associated with the second bellcrank 8. It is important to note that, due to the lever length procured by the synchronization bar 9, small differences in the groove 23 can result in large variations in the angle of the second bellcrank 8. The function of the second groove 26 is to make the mechanism statically determinate while contributing to defining the control law. A second short groove 26, that does not extend the second bellcrank 8, will often be sufficient. FIGS. 3*a,* 3*b* and 3*c* illustrate a situation in which the pin 27 at the end of the synchronization bar 9 is close to the same end of the second groove 26 at extreme positions of the rod 11 of the jack 10 (at FIGS. 3*a* 3*c*), while it is close to the opposite end of the second groove 26 for an average deployment of the rod 11 (FIG. 3*b*).

The control law generally depends on a large number of factors, essentially directions and shapes of grooves 23 and 26 and their positions with respect to bellcranks 7 and 8. Two main steps in the movement can be distinguished in the example considered here. In the first step, between the states in FIGS. 3*a* and 3*b,* the first groove 23 is firstly approximately parallel to the path of the articulation point of the synchronization bar 9 to the first bellcrank 7, such that the synchronization bar 9 is lowered without changing the inclination very much; but the direction of the second groove induces a larger rotation of the second bellcrank 8 than the rotation of the first bellcrank 7, as the pin 27 moves in the second groove 26.

In the second step of the movement, from FIG. 3*b* to FIG. 3*c,* the first groove 23 is not sufficiently oblique to prevent significant straightening of the synchronization bar 9, that is accompanied by a change in inclination that reduces rotation of the second bellcrank 8. In the final state in FIG. 3*c,* the movement of this second bellcrank 8 is not as large as the movement of the first bellcrank 7.

The invention could be used in many other situations, and particularly to control a larger number of blade stages. It would then be used with a large number of synchronization bars. These synchronization bars, based on existing devices, could either be in sequence, in other words could connect adjacent bellcranks and be extended in a chain, or they could be parallel and extend as far as a common bellcrank or even as far as the actuator element itself. This has no consequence for the invention.

The invention claimed is:

1. Variable pitch device for two stages of stator blades (2), arranged on a casing (1) and provided with an actuator mechanism, and a bellcrank (7, 8) for each stage, pivoting on an axis (20, 21) of the casing and a stage control connecting rod (6) connected to a branch of the bellcrank, a synchronization bar (9) being connected to another branch of at least one of the bellcranks to displace it, characterized in that the synchronization bar is connected to the casing through a groove connection (23) and a pin (22) sliding in the groove, and to the bellcrank that it displaces by another groove connection (26) and a pin (27) sliding in the another groove.

* * * * *